US006283347B1

(12) United States Patent
Roh

(10) Patent No.: US 6,283,347 B1
(45) **Date of Patent: *Sep. 4, 2001**

(54) FULLY ENCLOSABLE BACKPACK BABY CARRIER

(76) Inventor: Warren E. Roh, 7753 S. Ames Way, Littleton, CO (US) 80128

( * ) Notice: Subject to any disclaimer, the term of this patent is extended or adjusted under 35 U.S.C. 154(b) by 0 days.

This patent is subject to a terminal disclaimer.

(21) Appl. No.: 09/528,568

(22) Filed: Mar. 20, 2000

Related U.S. Application Data

(63) Continuation-in-part of application No. 09/040,764, filed on Mar. 18, 1998, now Pat. No. 6,092,543.

(51) Int. Cl.[7] ..... A47F 3/04; A47F 3/08

(52) U.S. Cl. ..... 224/160; 2/4; 2/456; 224/657

(58) Field of Search ..... 2/4, 456; 224/160, 224/161, 657

(56) References Cited

U.S. PATENT DOCUMENTS

| | | | | |
|---|---|---|---|---|
| 598,995 | | 2/1898 | Jacob . | |
| 1,940,224 | | 12/1933 | Munro . | |
| 2,344,811 | * | 3/1944 | Gill | 2/2 |
| 2,628,358 | | 2/1953 | Neils . | |
| 3,799,414 | | 3/1974 | Fiffer | 224/6 |
| 4,009,808 | | 3/1977 | Sharp | 224/6 |
| 4,333,591 | | 6/1982 | Case | 224/160 |
| 4,903,873 | * | 2/1990 | Poole et al. | 224/160 |
| 4,923,104 | | 5/1990 | Rice | 224/155 |
| 5,004,134 | * | 4/1991 | Barry | 224/209 |
| 5,570,823 | * | 11/1996 | Lindy | 224/160 |
| 5,685,466 | * | 11/1997 | Hsieh | 224/160 |
| 5,735,004 | * | 4/1998 | Wooten et al. | 5/502 |
| 5,848,741 | * | 12/1998 | Fair | 224/160 |
| 6,055,686 | * | 5/2000 | Knight | 5/494 |
| 6,092,543 | * | 7/2000 | Roh | 135/96 |

* cited by examiner

*Primary Examiner*—Stephen P. Garbe
(74) *Attorney, Agent, or Firm*—Thomas W. Hanson

(57) ABSTRACT

A fully enclosable backpack style baby carrier which protects the baby from sun exposure, insects, rain, snow and light impacts such as from overhanging branches. The carrier remains enclosed while the carrier is being carried and while it is set on the ground. The configuration of the fabric enclosure allows the stand, carrying straps, etc. to be attached to the frame without penetrating the inner layer, preserving the integrity of the enclosure. Mesh panels are used throughout to provide ventilation while excluding insects. A head enclosure encloses and protects the baby's head while providing significant ventilation.

22 Claims, 18 Drawing Sheets

FULLY ENCLOSABLE BACKPACK BABY CARRIER

CROSS-REFERENCE TO RELATED APPLICATION

This application is a continuation-in-part of application Ser. No. 09/040,764, filed Mar. 18, 1998, now U.S. Pat. No. 6,092,543.

FIELD OF THE INVENTION

This invention relates to backpack style baby carriers and more specifically to such backpack carriers which incorporate protection from weather, insects, and impact.

BACKGROUND OF THE INVENTION

The use of various types of apparatus for carrying a baby without the use of the parent's hands is well known. One of the more recent developments in this area is the backpack type of carrier. A seat is provided for the baby which is attached to a frame. The frame is fitted with straps and adapted to be carried on the back in a manner similar to a conventional backpack. These have enjoyed increasing popularity because of their convenience and the increased weight that can be carried and the time for which that weight can be carried. This type of baby carrier has made feasible extended walks and even off-road hiking while carrying a baby. It is becoming increasingly common for theses carriers to include a collapsible support stand which allows the carrier to be placed upright on the ground. This makes it possible to place the baby in the carrier and secure it while the stand is sitting upright; simplifies the process of donning the carrier; and allows the carrier to be used as a temporary seat.

As experience with the backpack form of baby carriers has accumulated, several problems have become apparent. Many of these problems are magnified for extended, off-road hikes. First, most carriers do not provide sun protection for the baby. The apparent assumption is that the baby's apparel will provide this protection.

Recent research has emphasized the importance of protecting babies and infants from sun exposure. Immediate effects of sunburn can include dehydration, fever, faintness, delirium, shock, dangerously low blood pressure, and irregular heart beat. Long term effects are also a serious concern. Early sun exposure increases the risk of skin cancer, wrinkles, and even cataracts in later life and the damage is cumulative, building with each sunburn or even each exposure. Research indicates that two or more blistering sunburns as a child or teen doubles the risk of melanoma, the deadliest form of skin cancer, later in life. These risks are compounded by the fact that baby's skin is thinner and will sunburn more easily than an adult's skin. Further, since babies can not communicate they can't tell a caregiver when they are getting too hot or beginning to sunburn. Where the baby is in a carrier on the caregiver's back, the caregiver may not notice the condition developing. Current recommendations include providing protective clothing including broad brimmed hats which shade the ears, nose, and lips; using sunscreen for babies over six months of age; and keeping babies under six months of age out of direct sunlight entirely. Protection is important even on overcast days, as damaging UV rays can penetrate light clouds and haze. See Sunproofing Your Baby, The Skin Cancer Foundation (1992); and Fun in the Sun: Keep Your Baby Safe, American Academy of Pediatrics (1995).

Second, no protection from insects is provided. This lack can become critical in natural settings where swarms of mosquitoes or flies, bees, hornets, ticks, or other stinging or biting insects may be encountered unexpectedly and avoidance is not an option.

Third, no protection from airborne debris is provided. Winds can pick up and propel leaves, needles, dirt, twigs and other debris with sufficient force to irritate or even injure an unprotected baby.

Fourth, backpack baby carriers are often designed to position the baby's head slightly above that of the adult carrying them. This provides them with an unrestricted view, and improves the weight distribution. However, this position also exposes the baby to the risk of possible impact with overhanging branches, rocks or other protrusions which the adult may not notice because they are above the adults head.

When the walking or hiking activity is taking place in warm or hot weather, it is also important that the baby be kept cool and that the carrier not overheat the adult who is carrying it.

Protection has been made available for backpack style baby carriers both by creating packs with integral covers and by providing supplemental covers which can be added to a carrier. U.S. Pat. No. 4,923,104 is typical of an integrated design. The design fully encloses the infant and provides a viewing panel so that the infant can see out. However, the design is not appropriate to warm weather use, much less hot weather. Little, if any, provision is made for ventilation. In warm, sunny weather, the infant would quickly overheat. The design also does not allow for the use of an internal frame structure, especially not one with an integral stand. The simple approach described could not retain a gap free enclosure while allowing the stand to be deployed. The design also does not provide for impact protection for the infant. While some protection is inherent, the structure has little resistance to laterally moving object, such as overhanging branches.

One design for providing supplemental protection for a baby in a backpack style carrier is disclosed in U.S. Pat. No. 4,333,591 to Case. This is a foul weather cover for a carrier which is designed primarily to provide protection against wind and rain. The design is essentially a sack which encloses both the carrier and the baby, utilizing a drawstring to cinch the upper end around the baby, leaving the head exposed. Because the cover closes around the baby, chafing or irritation could result from the contact. Slits are provided in the cover through which the shoulder and waist straps of the carrier can pass when in use. The lower end of the sack is wider than the top, allowing for the carrier's stand to be extended. This can result in a significant amount of loose material bunching around the lower end of the carrier when the stand is collapsed. Pockets are provided on the rear of the cover to hold various articles needed for the care of the baby. Significantly, the cover disclosed in Case does not fully enclose the baby. A separate hood is used to protect the baby's head, leaving a gap at the neck. No protection for the baby's face is disclosed. This lack of full enclosure makes the cover ineffective in protecting against insects or airborne debris. The cover is also inappropriate for fair weather or hot weather use. The water proof fabric would quickly result in overheating of the baby if in place during hot weather and possibly even during mild, sunny weather. No impact protection for the baby's head is provided.

There is a need for a cover for a backpack style baby carrier with an integral cover which provides protection for the baby from exposure to the sun, insects, and flying debris while maximizing the ventilation available to the baby and to the person carrying it. The cover should provide full enclosure with no paths through which either a crawling or flying insect can penetrate to reach the baby. The cover should not come into contact with the baby when in normal use, to prevent chafing or irritation. Preferably this cover would also provide impact protection against overhanging hazards such as tree branches. The cover should not interfere with the normal operation of the carrier, including the use of the collapsible stand. Preferably, the backpack should be sufficiently compact to conform to airline carry-on baggage size standards.

SUMMARY OF THE INVENTION

The present invention is a fully enclosable backpack style baby carrier. The carrier includes a supporting structure, such as a frame, and a fabric enclosure which completely surrounds the baby, providing protection from sun exposure, insects, and light impacts. The enclosure includes a body and a head enclosure which can be opened or folded back. The body generally encloses the bottom portion of the baby up to about the level of the shoulders. The head enclosure encloses the baby from that point upward and includes opaque panels to shield the baby's head and shoulders from the sun. In the preferred embodiment a zipper is used to seal the two parts together, keeping out insects. Both the body cover and the head cover make use of mesh panels to provide ventilation while keeping out insects. Preferably, the enclosure is removable from the structure.

According to the invention there is provided a supporting structure, plural carrying straps, and a fabric enclosure which surrounds the baby comprising a body and a head enclosure with means to attach them together. Preferably, both the body and head enclosure incorporate at least a portion of insect resistant mesh.

According to an aspect of the invention the enclosure comprises a pocket of fabric which fits within the structure, providing a complete, uninterrupted enclosure.

According to another aspect of the invention the mesh has a very fine porosity of at least 1200 openings per inch and a burst strength of at least 40 psi.

Further in accordance with the invention the head enclosure incorporates at least one panel which is substantially opaque to ultraviolet rays.

Still further in accordance with the invention, the head enclosure comprises a support means which holds the fabric out of contact with the baby's head. Preferably this is formed as an arcuate resilient rod or tube.

Yet further in accordance with the invention, the head enclosure also comprises an impact guard attached to the support means.

Yet still further in accordance with the invention, the mesh may be printed to alter visibility through the mesh and/or treated with an insect repellant to further discourage entry of insects.

The advantages of such an apparatus are a backpack style baby carrier with integral enclosure which protects the baby from sun, insects, and flying debris. It also provides a measure of protection from impacts with overhanging branches an other hazards. The enclosure is not compromised by the carrying straps or support stand and does not interfere with either. The carrier is more convenient to use than a carrier with a separate enclosing cover.

The above and other features and advantages of the present invention will become more clear from the detailed description of a specific illustrative embodiment thereof, presented below in conjunction with the accompanying drawings.

DESCRIPTION OF THE PREFERRED EMBODIMENT

The following discussion focuses on the preferred embodiment of the invention, wherein a backpack style baby carrier incorporates a fully enclosing cover, with mesh body and head enclosure. However, as will be recognized by those skilled in the art, the disclosed invention is applicable to a variety of such carriers and can be adapted to similar conveyances and still be within the scope of the invention.

The following is a brief glossary of terms used herein. The supplied definitions are applicable throughout this specification and the claims unless the term is clearly used in another manner.

Baby—generally the occupant of the backpack enclosed by the invention. Also includes infants of any age that can also be carried in such a device.

Baffle—an element which serves to block or impede entry. Specifically, such an element which resists the entry of insects into the cover.

Enclosure—generally the fabric, and or mesh components of the backpack baby carrier which cooperate to fully enclose the baby. Some elements for the enclosure may also have a structural role.

Parent—used as a general term to describe the person carrying the baby backpack, even though that person could be any caregiver.

The disclosed invention is described below with reference to the accompanying figures in which like reference numbers designate like parts. Generally, numbers in the 200's are used to refer to the occupant of the carrier or the person carrying it or objects in the surrounding environment. Reference numbers in the 300's are used to refer to parts of the disclosed invention.

Features of the Preferred Embodiment

Figure 1:
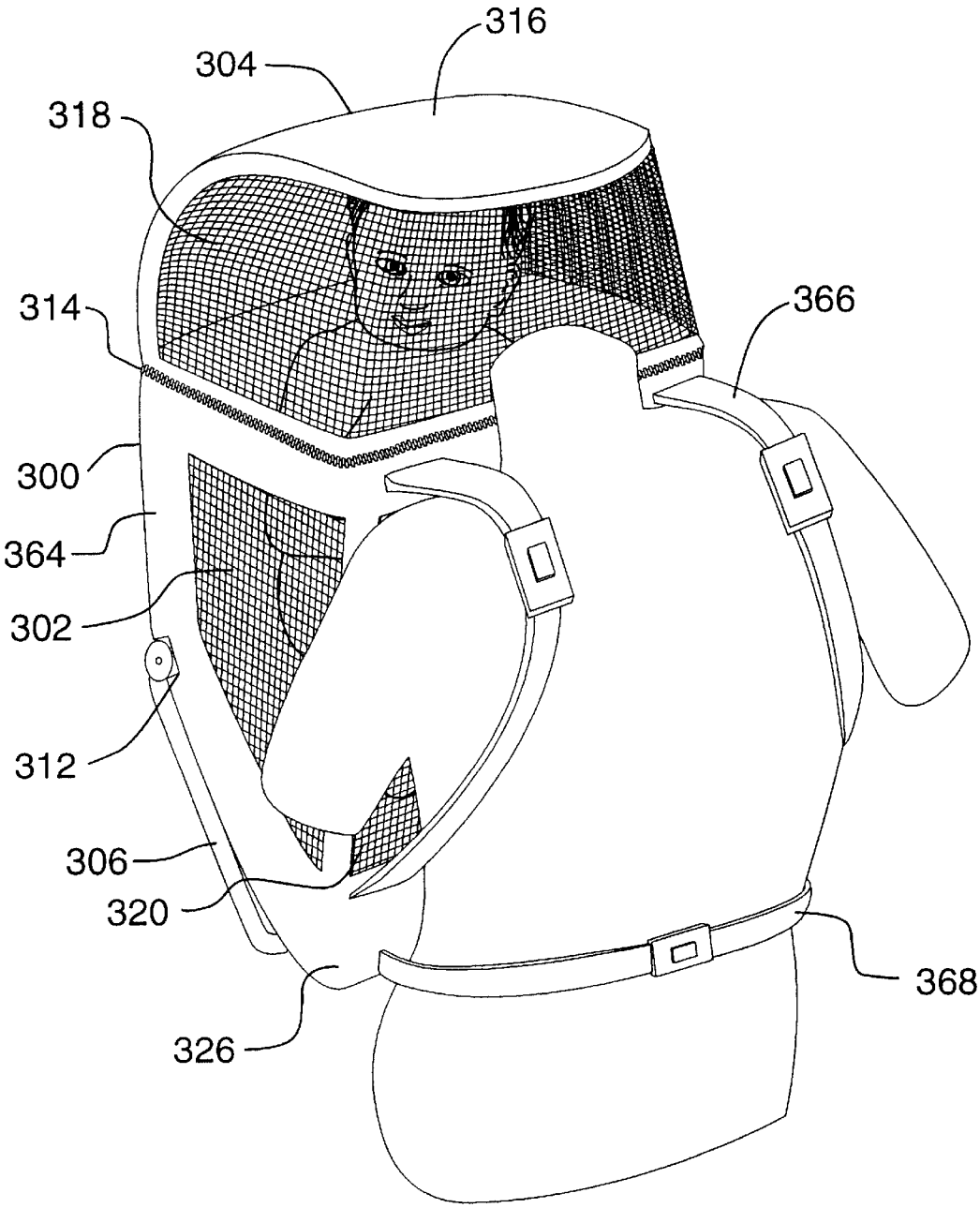
FIG. 1 illustrates the inventive backpack baby carrier being carried by an adult.

The inventive backpack baby carrier, 300, is shown in FIG. 1. The enclosure, 364, fully encloses the carrier and the baby without interfering with the normal functioning of the carrier. The majority of the enclosure is comprised of fine mesh panels, 302, 320, and 318, to provide ventilation while excluding insects, dirt, leaves, and other debris. Panel, 320, also provides ventilation and cooling for the parent's back. An additional benefit to these mesh panels is that they are sufficiently sheer that the baby and the carrier can be seen through the mesh. This greatly simplifies the positioning of the baby in the carrier as compared to performing the same task with an opaque cover in place. A further benefit is that the mesh is sufficiently fine that it will deflect or diffuse light rainfall, or even snow, reducing the impact on the child. While the enclosure is not intended for rain protection, it will reduce the impact should an unexpected shower occur.

The head enclosure, 304, utilizes an opaque panel, 316, on the top and rear to provide protection from sun exposure. The mesh panel, 318, encloses the other three sides to provide panoramic view, significant ventilation, and protection. The head enclosure will keep out insects, leaves, dirt and other wind blown debris and provides protection for the baby from light impacts as with overhanging branches. The head enclosure is self-supporting and does not come into contact with the baby during normal use. This avoids chafing and other irritation to the baby caused by some prior art covers. This is especially important in hot or humid weather. Zipper, 314, detachably connects three sides of the head enclosure to the body of the cover. This provides an easily removed coupling which is impenetrable by insects. The rear side is sewn to the body of the cover. Where full protection is not needed, the head enclosure can be unzipped, folded back, and stored in a pocket on the rear of the cover.

Figure 2:
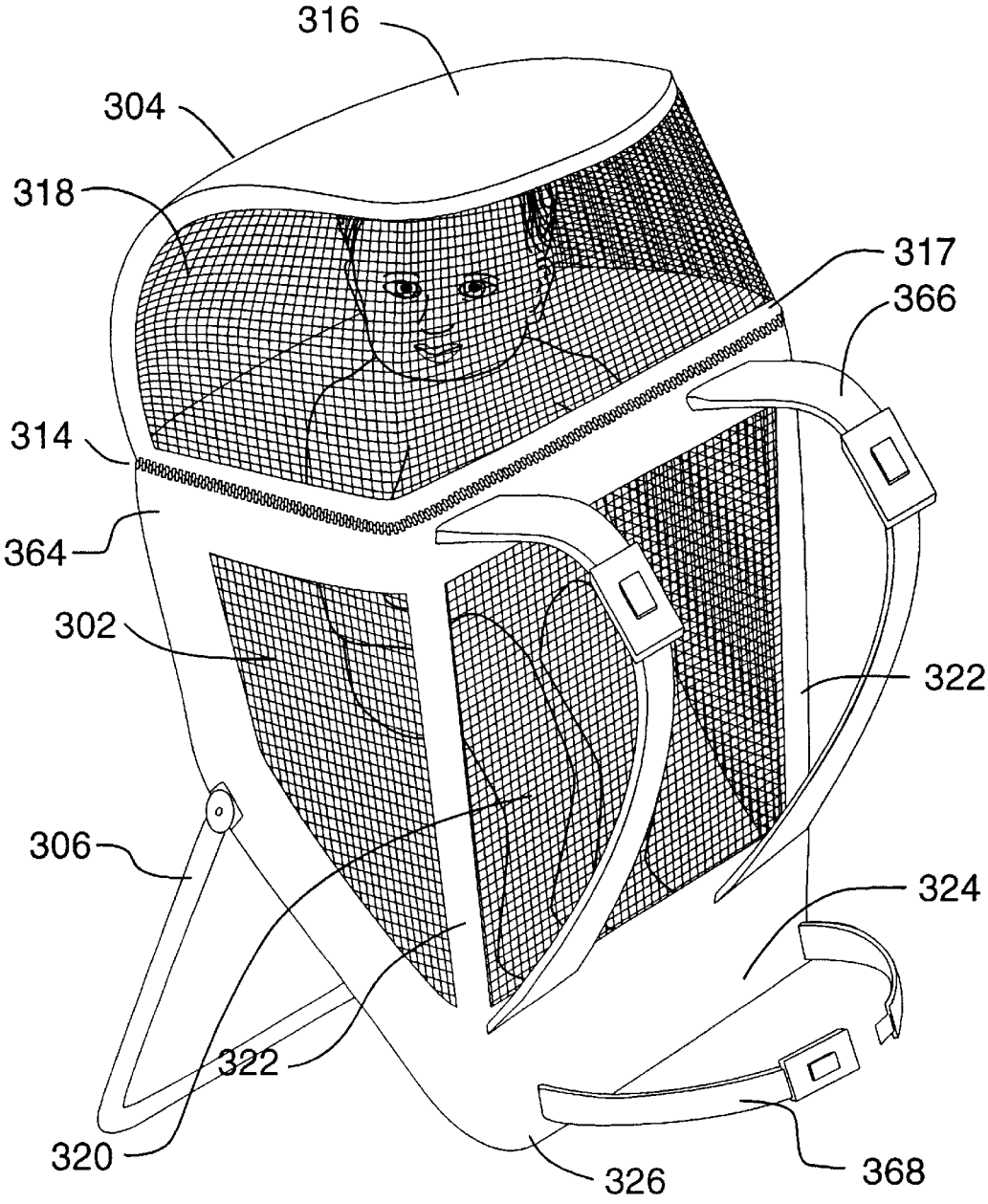
FIG. 2 illustrates the inventive backpack carrier supported by the collapsible stand.

The carrier can be taken off and set down with the enclosure in place, as shown in FIG. 2. Opening, 312, allows the backpack's stand to pass through the cover and connect to the frame. The opening is sealed behind the frame member to prevent entry of dirt or insects. With a conventional baby carrier in this position, the baby would be exposed to crawling insects which could climb up the frame or the straps. However, with the present invention, the child remains fully enclosed and protected from the sun, insects and other environmental hazards. Because the carrier is fully enclosed, entry to even crawling insects is extremely difficult. Panel, 320, provides increased ventilation over what was available when the baby was being carried. Because the mesh panels are sheer, the baby can be viewed and monitored while still within the cover. The lower portion of the body, 326, is constructed of a waterproof, breathable material. When the carrier is set down, these areas will not absorb moisture and will prevent dirt from entering the carrier. The overall result is a baby who is shaded, cooled, undisturbed by insects or blowing debris but can still see out and be seen. This will likely make the experience more pleasant for both the baby and the parent.

Structure of the Preferred Embodiment

The disclosed backpack baby carrier serves primarily to provide protection for a baby in fair, hot, or humid weather. To this end, the design of the carrier seeks to attain several goals. First among these is the exclusion of insects, whether flying or crawling, from the carrier. This is followed closely by the provision of maximum ventilation to keep the baby cool. Other goals include protection of the baby from exposure to the sun; protection from light impacts as from flying debris or overhanging branches; and no required contact between the baby and the carrier beyond that for a conventional carrier. Over riding all of these goals is the requirement that the cover be safe for both the baby and the parent. The design addresses these goals for two modes of operation of the carrier: as it is being carried, and while held erect by the stand on a flat surface. While the stand is a valuable feature it is not essential to the present invention. A fully enclosed, backpack style carrier without the stand is an alternative embodiment.

The safety requirement is addressed in the choice of materials and design techniques. The selection of breathable fabrics and extensive use of mesh significantly reduces any risk of suffocation hazard, even when the head enclosure is loose from the carrier. This is in contrast to some existing carrier covers which utilize waterproof fabrics. The design utilizes curved edges and rounded corners to eliminate sharp angles and protrusions which could cause injury or snag on obstacles or branches.

A feature of the inventive backpack is that its outer dimensions conform to the current airline carry-on baggage size standards (22"×14"×9"). An alternative embodiment specifically designed to meet these standards while increasing safety incorporates a folding stand. In addition to collapsing forward against the pack, the stand collapses toward the center of the pack. The cross brace folds at a centrally located joint and the outer ends are hinged. The upper ends of the stand connect to the frame via ball joints or similar connections which allow movement in at least two dimension. In this way, the stand can extend outward beyond the sides of the pack, providing increased stability, especially resistance to sideward tipping. The ability to fold the cross brace allows the stand to be narrowed to within the sides of the pack, conforming to the carry-on standards and generally increasing the ease of carrying and loading.

Referring to FIGS. 1 and 2 it can be seen that a majority of the enclosure portion of the baby carrier is constructed from a mesh material. Depending on the size and dimension of the cover, 80% to 90% of the surface area of the carrier may be mesh. Panels 302, 320, and 318 surround the baby on three sides with mesh. Solid material is used only at wear and stress points and where sun protection is desired. Alternatively, these could also be constructed of mesh. In particular, the front corners, 322, may also be formed as a seam between two mesh panels, or panels 302 and 320 can be formed from a single continuous piece of fabric. The particular mesh used in the preferred embodiment has very small openings, up to 4000 per square inch, and high burst strength. The mesh used in the preferred embodiment scores 55–65 LB/in$^2$ in the Mullen D3847 burst strength test. The mesh itself is strong enough to block small pieces of gravel as might be thrown up by a passing car. These characteristics provide a material which is impassable to the smallest insects, including "no-see-ums", tear resistant, capable of blocking flying debris, and which still provides almost unrestricted air flow. Although in the preferred embodiment the rear panel is constructed from a solid material, this panel could also be constructed from mesh material to provide increase air flow. As a further alternative, the carrier can also be made with little or nor mesh on the body of the enclosure or solid panels can be provided to block airflow through the mesh on the body and/or head enclosure. This would extend the use of the carrier into colder weather.

The lower portion of the body, 326, is constructed of an opaque, waterproof, breathable fabric. In the preferred embodiment this is a Gore-tex® or Avalanche® type material. This further increases the overall breathability of the enclosure while blocking the intrusion of water and dirt. This also improves the durability of the enclosure as these portions of the cover will be subjected to the most wear and tear when the carrier is set on the ground. Panel, 324, which covers the hip pad on the carrier is also constructed of the same opaque material. This panel is subject to greater friction than most other panels as it is in constant contact with the parents hips while the carrier is being carried and the increased durability of the opaque material is needed. Further, this material provides a lower coefficient of friction relative to the mesh material, increasing comfort and reducing wear on the parent's clothing.

In the preferred embodiment, the shoulder straps, 366, and waist strap, 368, attach to the fabric of the enclosure. This simplifies the task of keeping the enclosure sealed. Alternatively, the straps could penetrate the outer layer of the enclosure and attach directly to the frame. The openings could then be baffled to prevent entry of insects and dirt or left open. As discussed below, the preferred embodiment utilizes a two-layer construction. Since the straps would penetrate only the outer layer, the baby is still not exposed.

Figure 3:
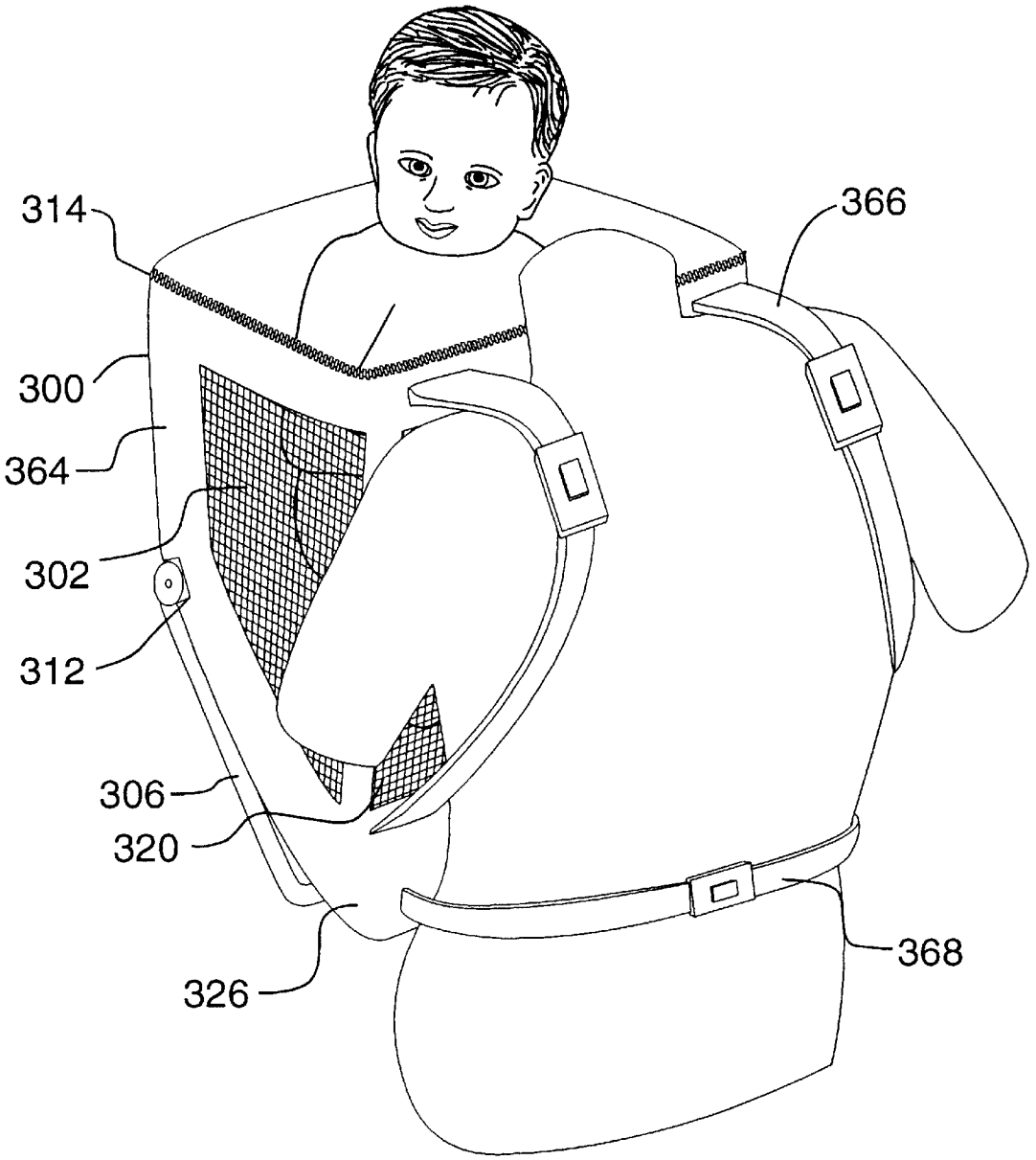
FIG. 3 shows the inventive backpack carrier with the head enclosure collapsed.

Referring to FIG. 3, the head enclosure has been folded back to expose the top of the carrier. The edges of the upper opening of the body of the enclosure are configured such that they are positioned outward of the inner edge of the carrier seat. This avoids unnecessary contact between the baby and the edge of the enclosure. While the baby may reach out and touch the enclosure, the design is such that the fabric does not bear on the baby. Such contact would be irritating to the baby, possibly resulting in chafing, especially during hot weather. Reducing such contact improves the baby's experience while using the carrier.

Referring again to FIGS. 1 & 2, the structure of the enclosure for the baby's head, 304, can be seen. The configuration of this enclosure is a unique feature of the carrier. It is designed to maximize ventilation and visibility while providing sun and insect protection, blocking or deflecting light impacts, and being easily opened to provide access to the baby. Mesh panel, 318, wraps around both sides and the front of the head enclosure. This provides unobstructed viewing, both in and out, on three sides as well as flow through ventilation while excluding insects and wind-blown debris. The opaque panel, 316, extends over the top and back of the enclosure providing sun protection from behind and overhead. Alternatively, a mesh panel can be added behind the baby's head to increase front to back flow-through ventilation.

Figure 4:
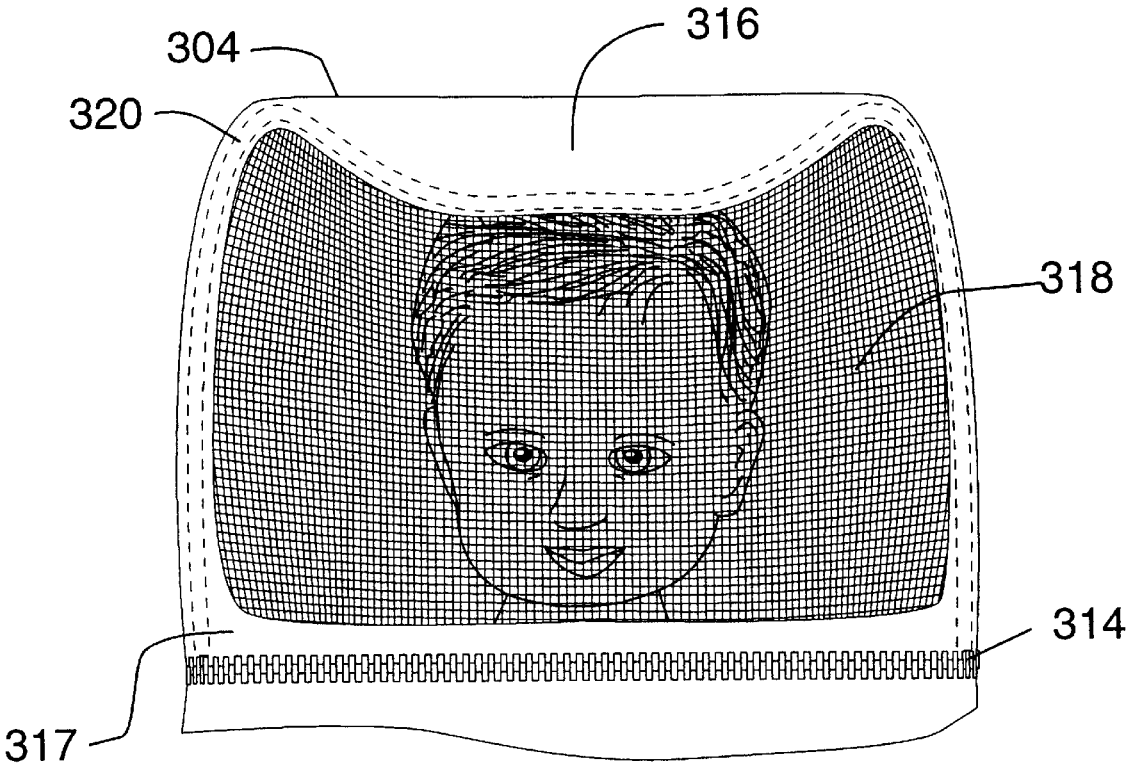
FIG. 4 provides a detailed front view of the preferred embodiment of the head enclosure.
Figure 5:
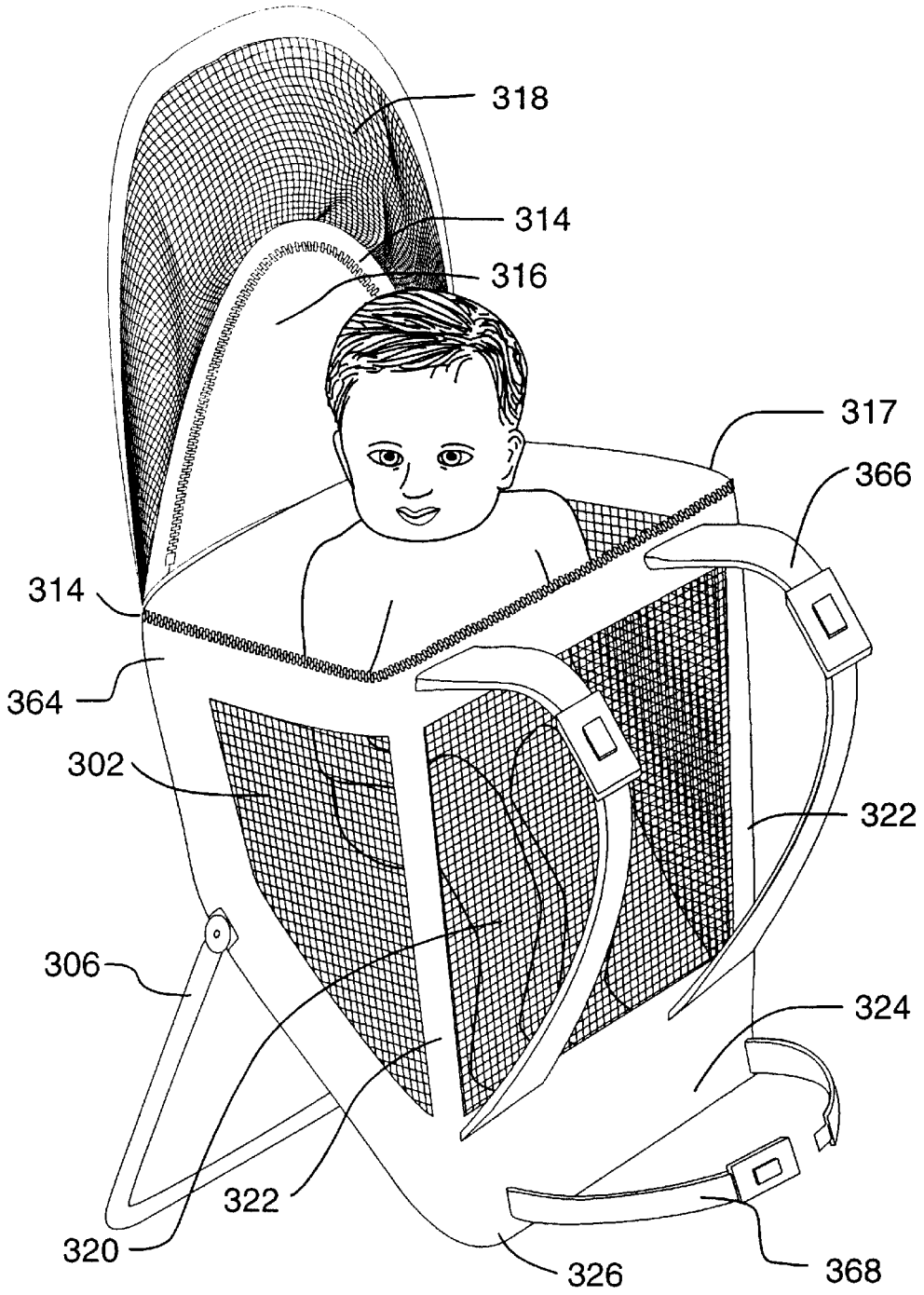
FIG. 5 illustrates the head enclosure in its open position where the support rod is attached to the rear of the body.
Figure 6:
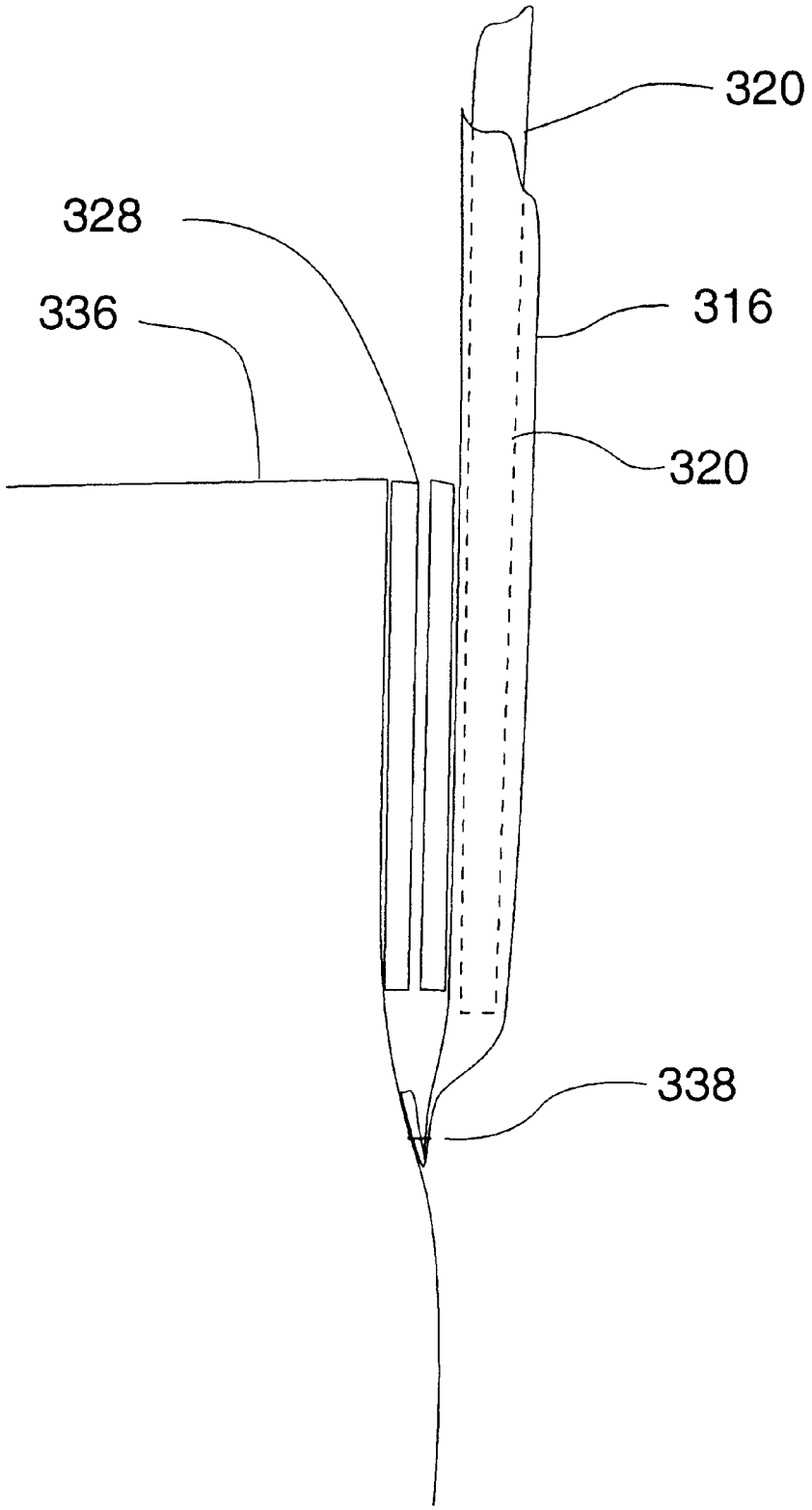
FIG. 6 provides a detailed view of the attachment of the rear corner of the head enclosure to the body of the backpack carrier.

The shape of the head enclosure, 304, is maintained by a resilient rod, 320 in FIG. 4, which is sewn into a pocket in the edge of the head enclosure. In the preferred embodiment, a continuous polycarbonate rod, high density polyethylene (HDPE) tube, or similar resilient material is used (hereinafter referred to generically as a rod) which attaches to the body of the enclosure at each end, as shown in FIG. 6, and discussed below. FIG. 5 shows the shape of the head enclosure when the rod ends are attached to the body of the enclosure and the zipper, 314, is open. The rod curves in one plane and holds the head enclosure upright and out of the way. The mesh panel, 318, lies flat against the opaque panel. This facilitates the insertion and removal of the baby from the carrier. When the zipper is closed, joining the head enclosure to the body of the enclosure, the rod is forced to curve in a second dimension, taking on the shape shown in FIGS. 1 & 2. The force exerted by the rod attempting to return to its natural, straight, condition, provides an upward and outward tension on the head enclosure, serving to hold the fabric and mesh panels taut. The upward component of this force also keeps the enclosure off of the baby's head.

A detailed view of the attachment of the rod, or tube, ends to the body of the enclosure is shown in FIG. 6. The lower, rear edge of the opaque panel, 316, is sewn to the body of the cover at seam 338. This seam extends transversely across the back of the cover. As discussed above, rod, 320, is enclosed in a pocket in the opaque panel. Hook and loop fastener, 328, is attached to the opaque panel adjacent to the end of the rod, and to the mating surface on the rear corner, 336, of the enclosure. When the head cover is raised into the vertical position, the two halves of the hook and loop fastener mate, holding the head enclosure in the vertical position shown in FIG. 5. From this position, the enclosure can be bent forward, and zipped closed, without releasing the hook and loop fastener. If it is desired to use the cover without the head enclosure, the hook and loop fastener can be released and the enclosure folded back along seam, 338, to lie flat against the rear of the carrier. If the enclosure will be unused for a significant time, it can be inserted into an optional pocket formed in the rear panel of the cover.

Figure 12:
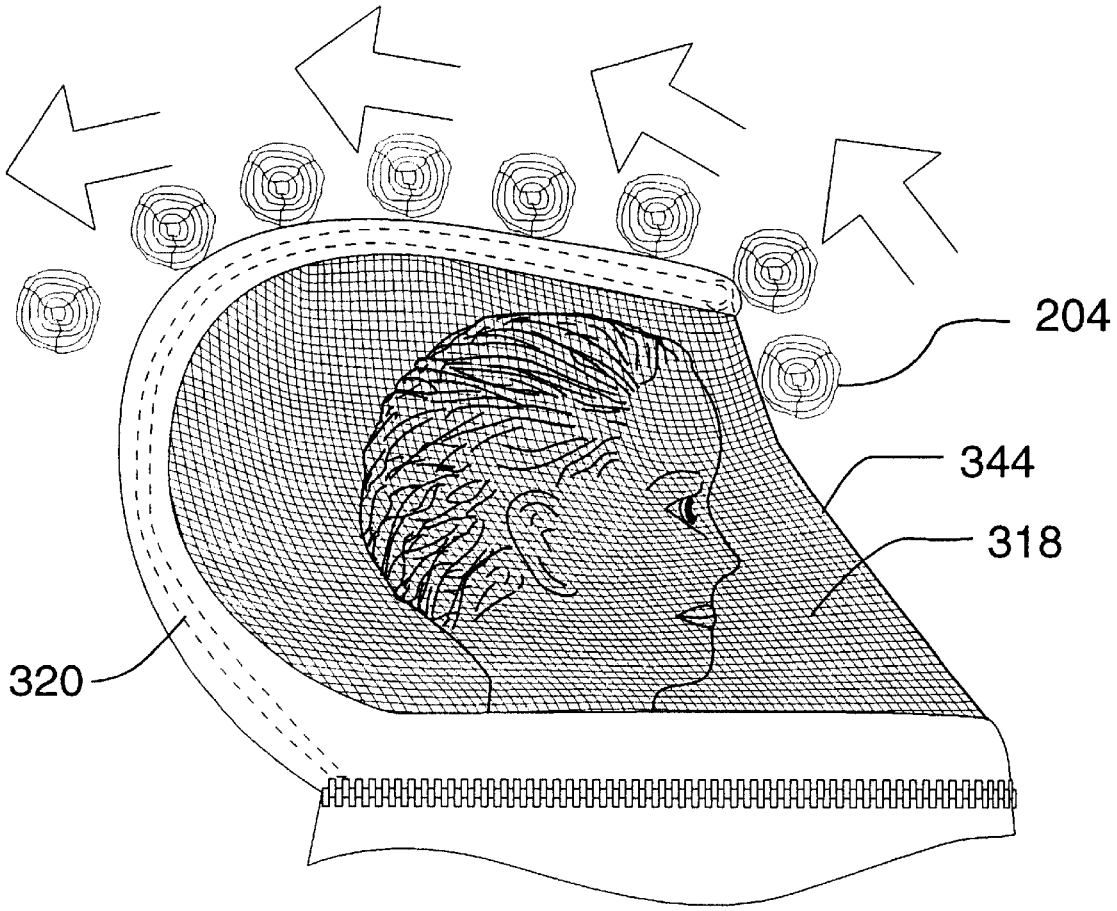
FIG. 12 illustrates the preferred form of the head enclosure deflecting a branch.
Figure 13:
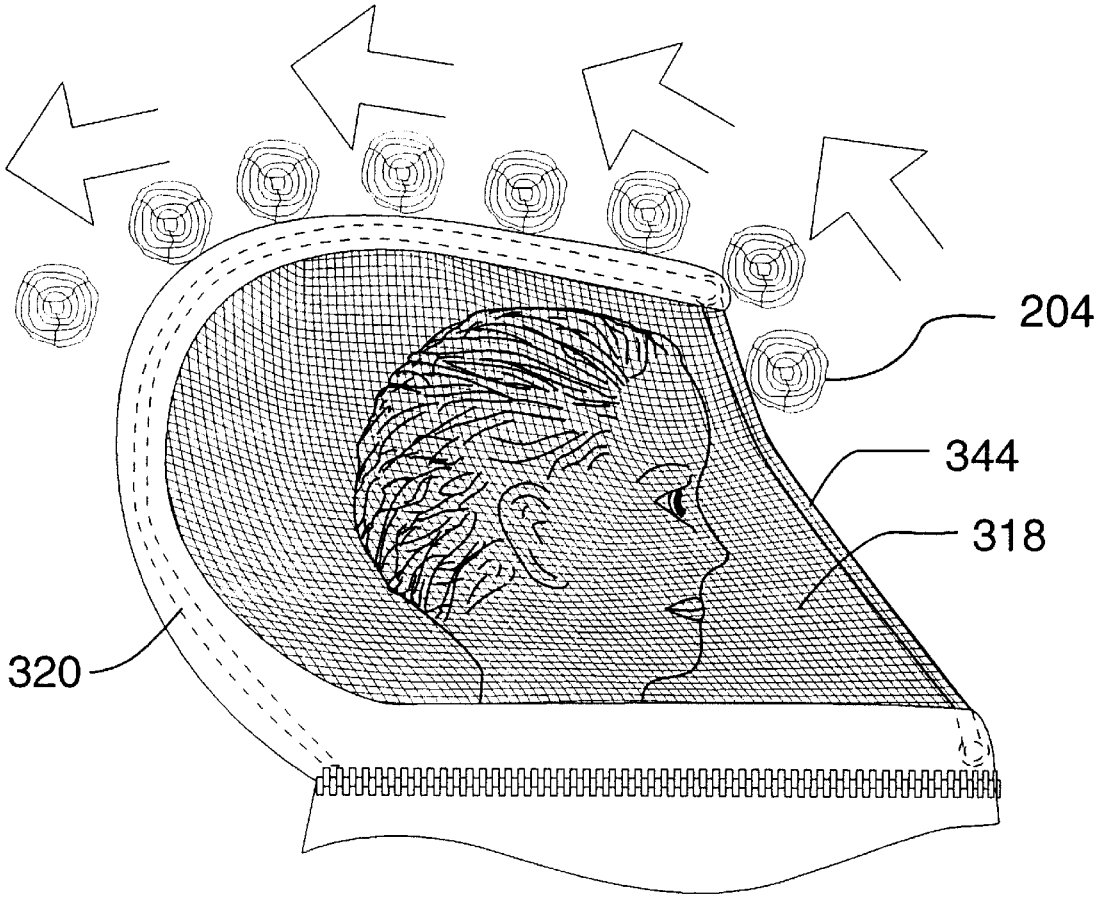
FIG. 13 illustrates the alternative form of the head enclosure deflecting a branch.

As shown in FIGS. 12 & 13, the head enclosure also provides protection against light impacts as would occur when the cover strikes an overhanging branch, 204. The design of the head enclosure, 304, is such that an impact against the front of the mesh panel, 318, and/or the rod, 344, will push the panel rearward and downward. This, in turn, will pull the rod, 320, and the front edge of the opaque panel, 316, downward over the baby's head increasing the protection. Further, as the panel is pulled downward, it forms a sloping surface which angles upward, over the baby's head. This surface acts as a ramp which redirects the branch upward, clear of the baby's head. By deflecting the impact rather than resisting it, protection can be provided against a relatively greater force. The amount of force which can be deflected depends primarily on the amount of tension and upward force provided by the rod. This force can be altered by changing the stiffness of the rod and the initial curvature of the rod. Because of the high tensile strength of the mesh, it is not a limiting factor. Altering the initial slope of the rod and opaque panel will also increase the protection by increasing the initial slope available to deflect objects. Alternative approaches to increasing the amount of protection are discussed below.

Figure 7A:
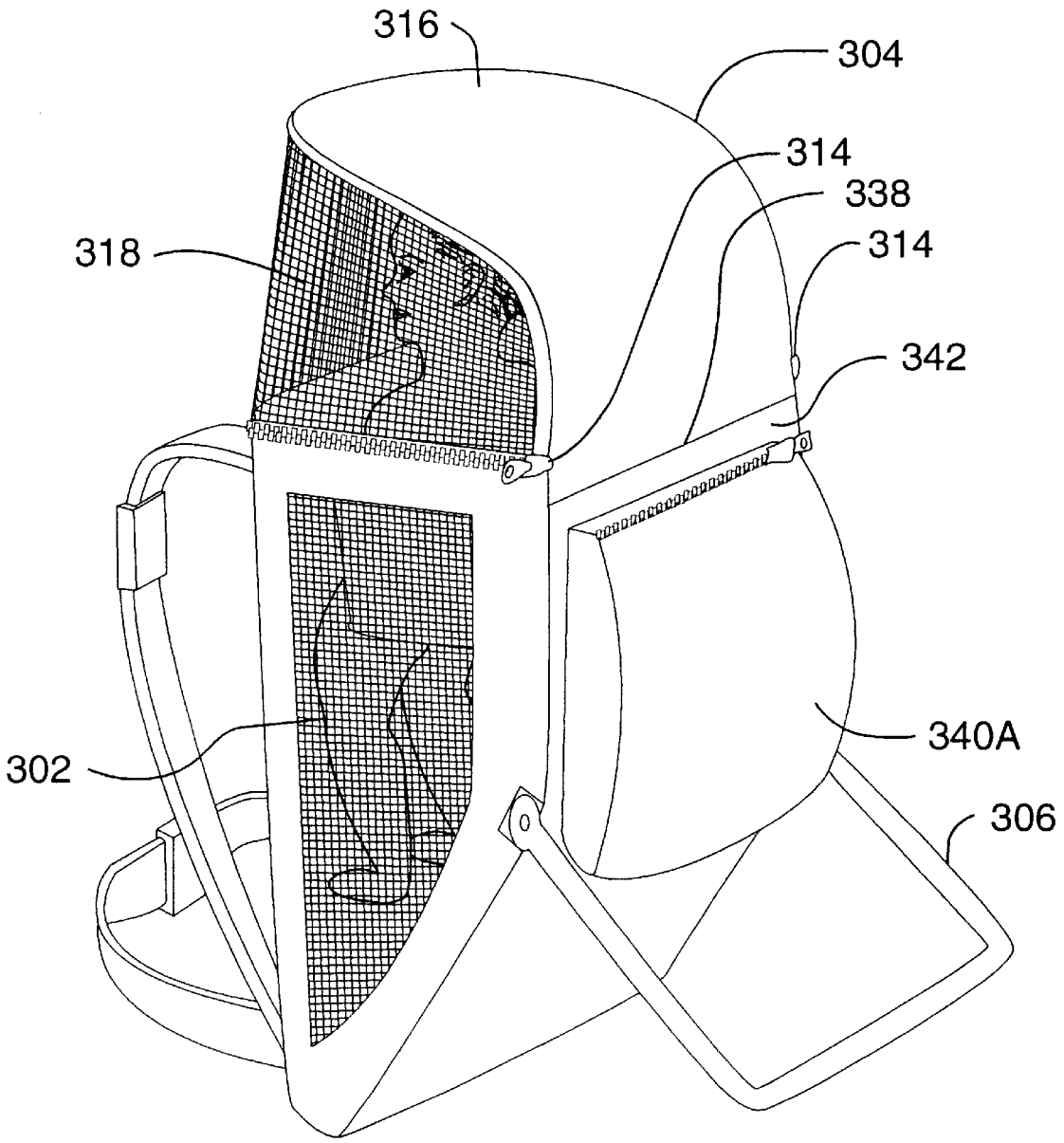
FIG. 7A provides a rear perspective view of a first embodiment of the present inventive backpack carrier illustrating a rear external pouch.
Figure 7B:
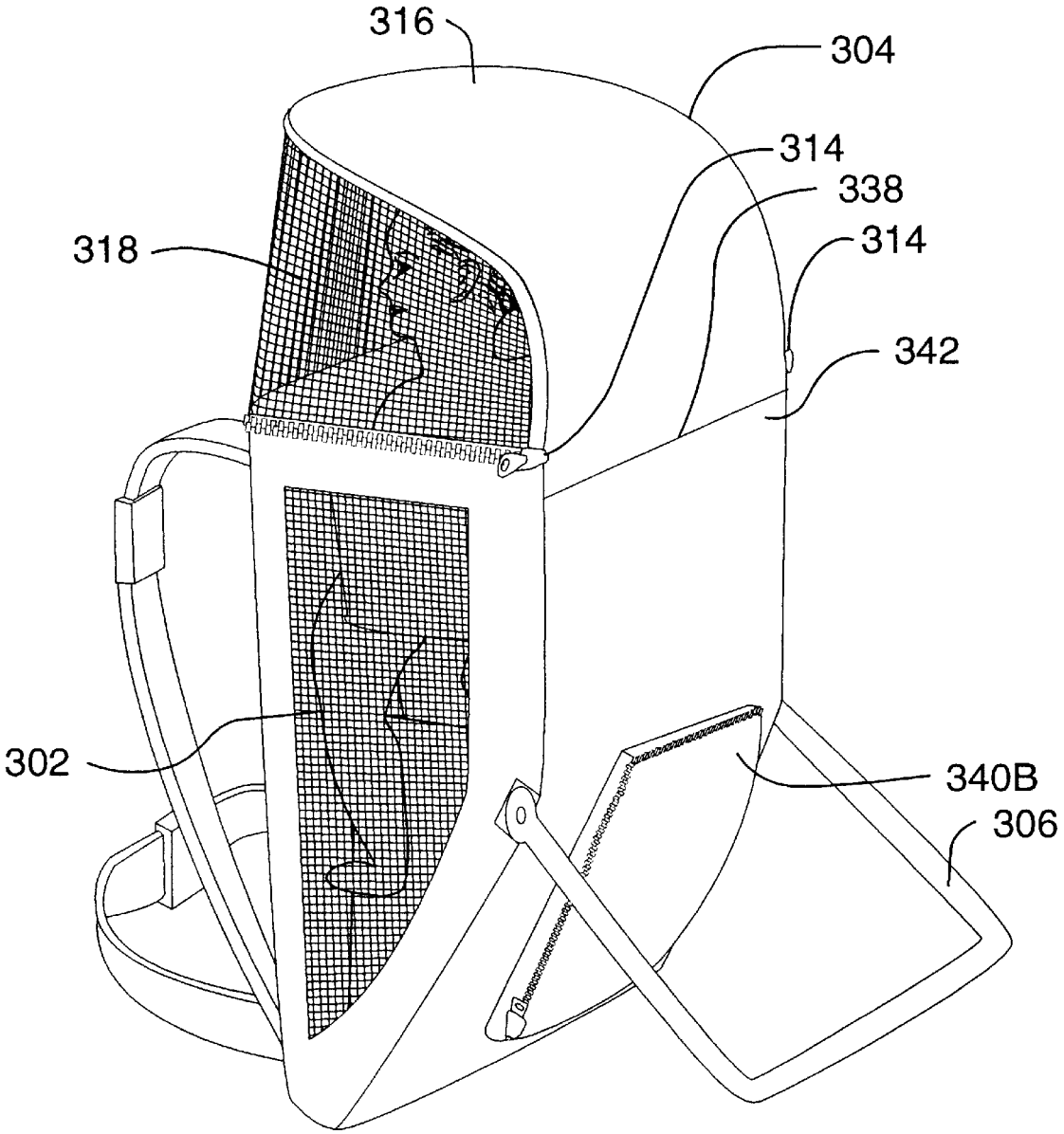
FIG. 7B provides a rear perspective view of a second embodiment of the present inventive backpack carrier illustrating an internal storage compartment.

As FIG. 7A shows, the preferred embodiment also includes one or more pockets or pouches, 340A, on the rear panel, 342, of the cover. These pockets provide storage for various items such as diapers, bottles, toys, etc. As discussed above, one of the pockets can also hold the head enclosure when it is folded back, not in use.

Figure 14:
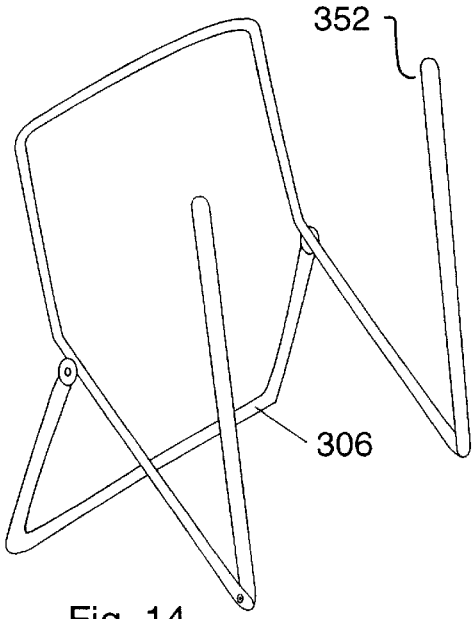
FIG. 14 illustrates the internal frame used in the preferred embodiment.
Figure 15:
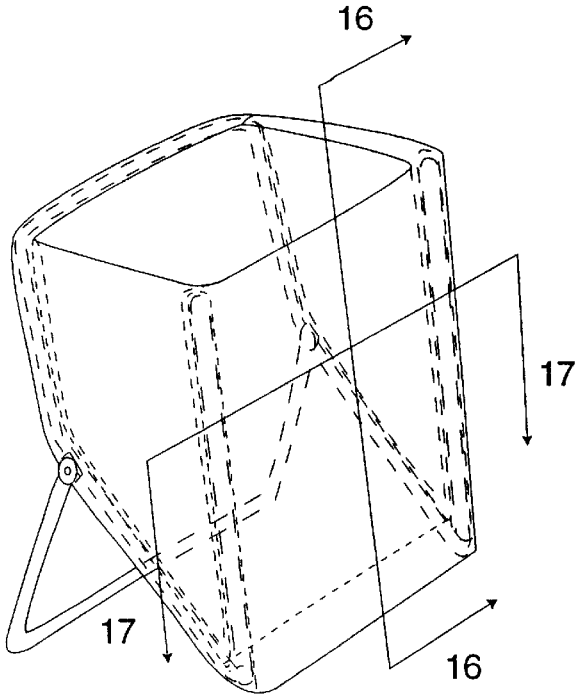
FIG. 15 illustrates how the frame fits into the enclosure of the preferred embodiment.
Figure 16:
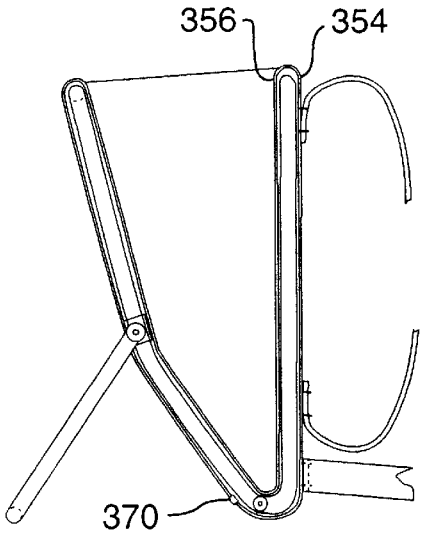
FIG. 16 is a vertical cross section through the preferred embodiment showing the arrangement of the enclosure

The preferred embodiment discussed above is a fully enclosed, internal frame backpack baby carrier. A frame, 352, as shown in FIG. 14, provides structural support for the fabric of the carrier. The body of the enclosure fully encloses all of the frame except for the stand, 306, as shown in FIG. 15. In the preferred embodiment, two layers of fabric are used. Referring to FIG. 16, the inner layer, 356, lines the inside of the frame, providing a continuous envelope around the baby. The outer layer, 354, covers the outside of the frame. This arrangement provides for secure attachment of the fabric to the frame, protects the frame itself from exposure and damage, and provides two layers of fabric around the baby in critical areas. A direct benefit of this is that where the outer layer is penetrated, either intentionally, as to allow for the stand, or unintentionally, if it is ripped or punctured, the inner layer retains its integrity and continues to shield the baby. As shown in FIG. 16, the preferred embodiment uses a single continuous piece of fabric for both the inner and outer layers. This simplifies construction and reduces the number of seams. Zipper, 370, joins the ends of the fabric, completing the enclosure of the pack. When opened, it allows the fabric enclosure to be removed from the frame for laundering or other purposes. Other arrangements could clearly also be used.

Alternative Embodiments

Several alternative embodiments of the disclosed invention are anticipated.

Figure 18:
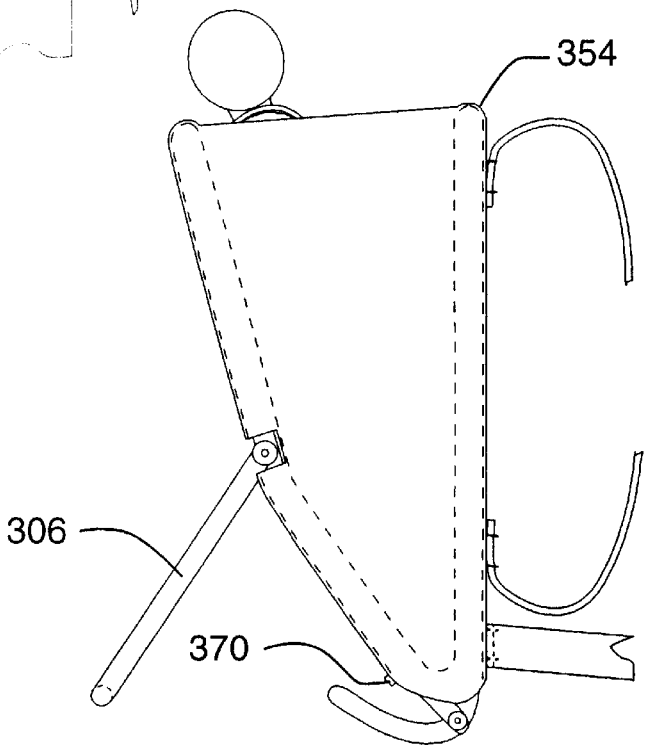
FIG. 18 illustrates an alternative embodiment of the present inventive backpack utilizing and external foot.

FIG. 18 illustrates a simple alternative frame structure in which external feet, 358, extend below the pack. This allows the pack to be set on the ground without having the fabric contact the ground, saving wear on the fabric. As with the opening for the stand, the opening in the outer layer of fabric for the feet does not compromise the integrity of the enclosure because the inner layer is not penetrated.

Figure 19:
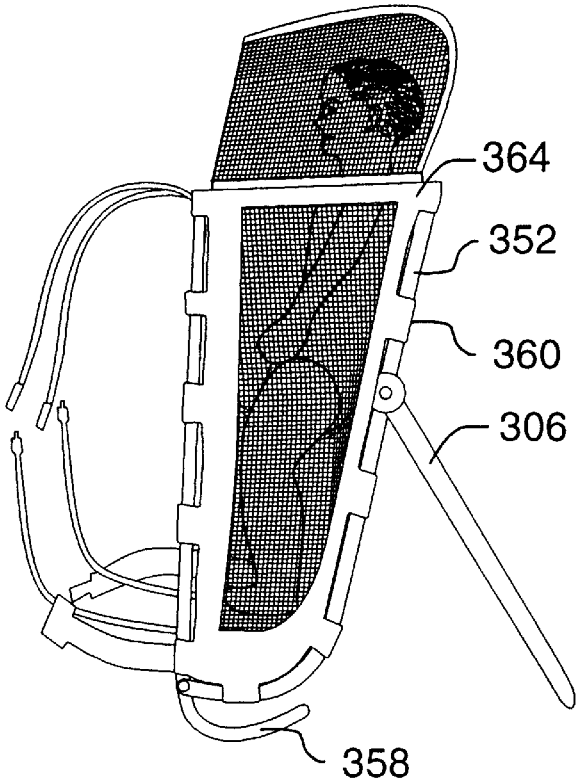
FIG. 19 illustrates an alternative embodiment of the present inventive backpack utilizing an external frame.

As FIG. 19 illustrates, the inventive backpack baby carrier can also be constructed as an external frame backpack. Rather than the double layer approach of the preferred embodiment, a single layer enclosure is used. The enclosure is then attached to the external frame, 152, via straps, 360. These may be formed as part of the fabric panel of the enclosure or as separate straps which are then attached. Either way, the straps encircle the frame securing the enclosure to the frame. This approach reduces the amount of fabric required, slightly reduces the weight, and provides an alternative aesthetic appearance.

Figure 20:
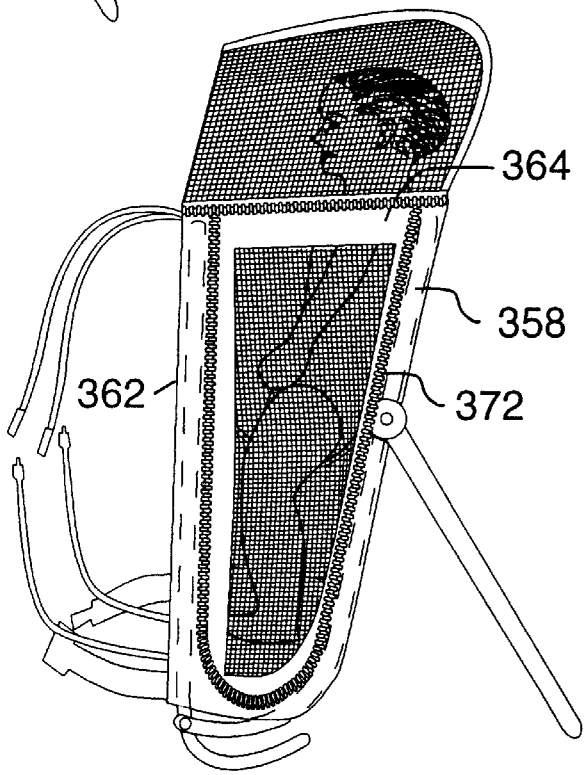
FIG. 20 illustrates an alternative embodiment of the present inventive backpack utilizing an external frame with fabric sleeves to provide for a removable enclosure.

A further alternative is illustrated in FIG. 20. Sleeves, 362, enclose and are permanently attached to the frame of the carrier. The enclosure is then removably attached to the sleeves by fastener, 372. This allows the fabric enclosure to be removed from the carrier for laundering or other purposes, such as exchanging summer and winter (without the mesh) versions of the enclosure. Zippers, hook and loop fastener, snaps, and a variety of other well known fastening means are usable to attach the enclosure to the sleeves.

Figure 17:
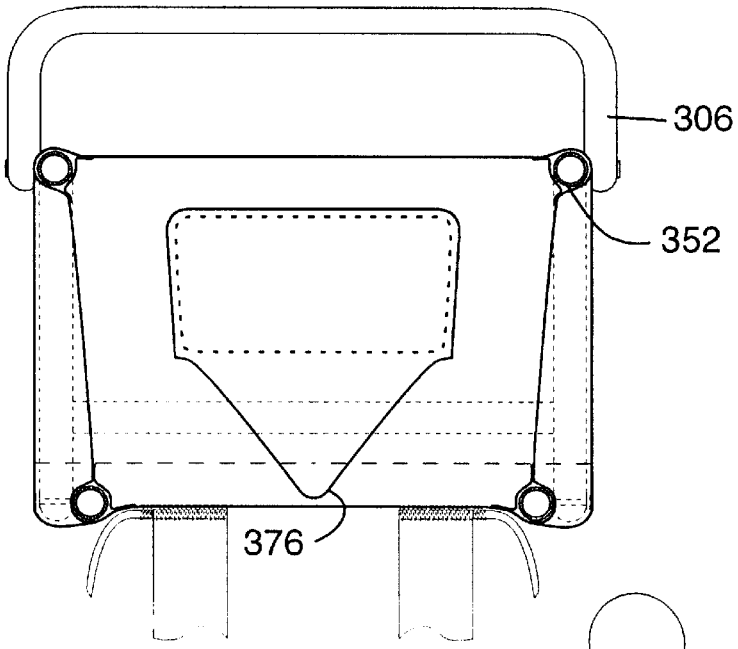
FIG. 17 is a horizontal cross section through the preferred embodiment showing the arrangement of the enclosure.
Figure 21:
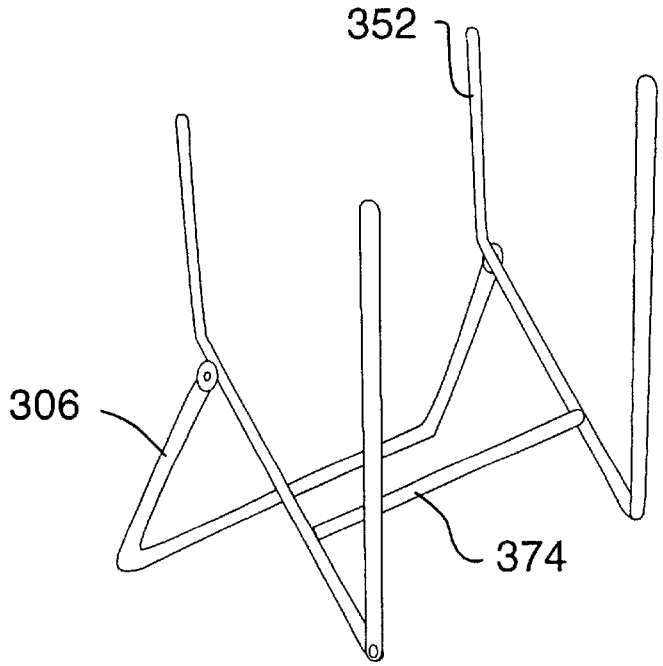
FIG. 21 illustrates an alternative embodiment of the internal frame.
Figure 22:
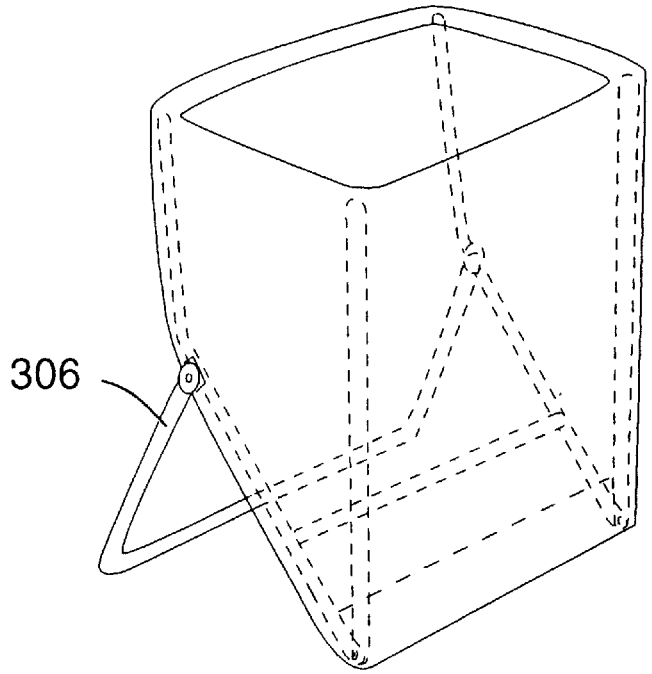
FIG. 22 illustrates how the frame fits into the enclosure of the alternative frame embodiment.
Figure 23:
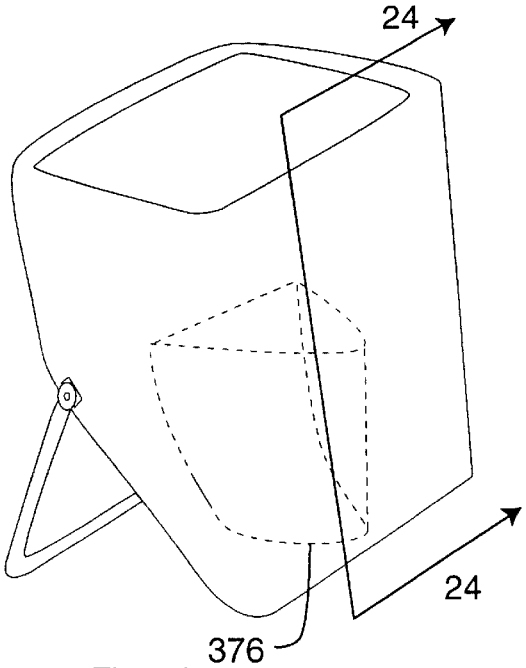
FIG. 23 illustrates an alternative embodiment incorporating an internal storage compartment.
Figure 24:
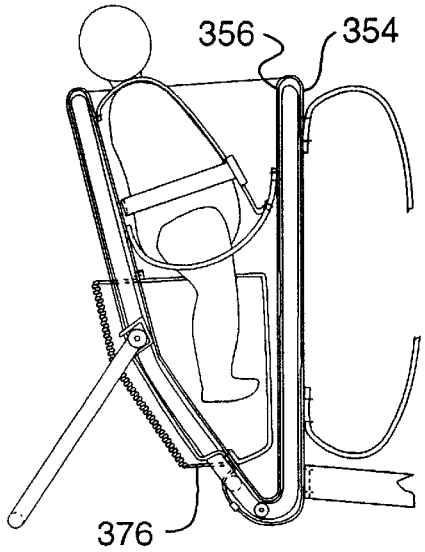
FIG. 24 is a cross section through the alternative embodiment of FIG. 23.

FIGS. 21 and 22 illustrate an alternative embodiment of the internal frame used with the pack. By removing the top cross-bar across the back, and replacing it with a lower brace, 374, it is easier to remove the fabric enclosure from the frame. It also allows making the fabric somewhat sturdier. As illustrated in FIG. 17, the inner and outer layers can be sewn together to form pockets for the frame uprights. This reduces the amount that the fabric can move relative to the frame. Because the top cross bar has been eliminated, the pockets will slide off the top of the frame.

The rigid frame of the above embodiments could also be replaced by a stiff, but non-rigid structure such as high density foam of sufficient thickness. This technique is well known in the art of backpacks where such a material forms a layer along the user's back, and/or along the sides of the pack, to stiffen and stabilize the pack.

FIGS. 23, 24, 7B, & 17 illustrate an alternative embodiment which incorporates an internal storage compartment or pouch, 376, which is accessible via panel 340B. The compartment is sewn to the inner layer of fabric, 356, so that the integrity of the inner layer is not compromised. It passes through the outer layer without permanent attachment so that the fabric enclosure can still be removed from the frame. The compartment is configured such that the baby's legs pass on either side of the compartment. This design utilizes space which is otherwise wasted while keeping it physically separated from the baby. It also moves the center of gravity of the stored items closer to the caregiver, reducing lower back stress and improving balance. If the ability to remove the fabric enclosure were to be sacrificed, the front of the compartment could be attached to the fabric forming the inner layer of the front of the enclosure, increasing the integrity of the enclosure by adding bracing. A releasable attachment could be used to retain removability while adding a measure of increased integrity.

Figure 25:
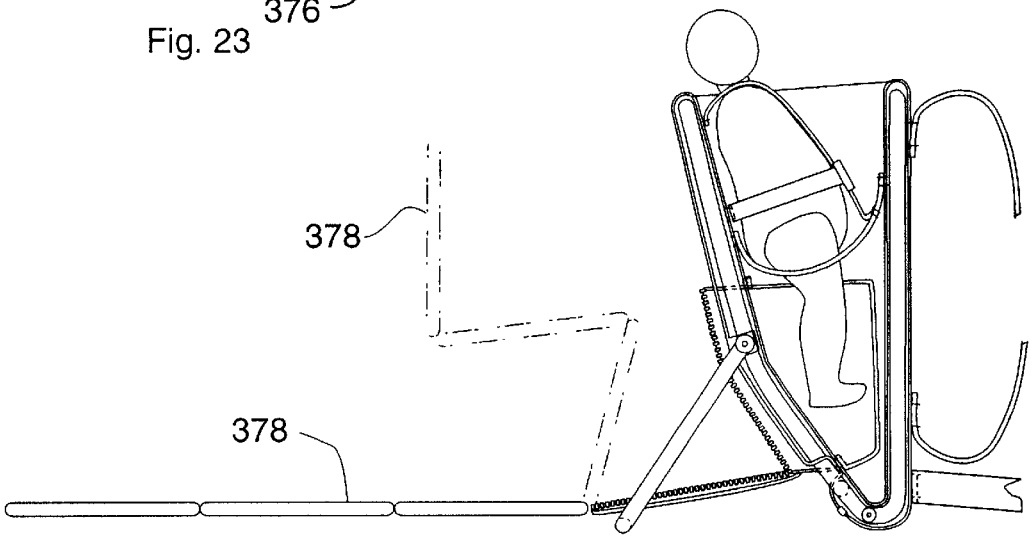
FIG. 25 illustrates a further alternative in which a collapsible changing table is added to the embodiment of FIG. 23.

FIG. 25 extends the above embodiment by adding a folding changing table, 378, which serves as panel 340B which closes the storage compartment. This table would preferably be made of a padding such as foam rubber, covered with a moisture impermeable fabric.

FIGS. 8 through 11 illustrate an adaptation of the head enclosure which increases the amount of impact protection provided. Vertical bar, 344, is added which interconnects the top panel, 316, of the head enclosure with the lower front edge, 317, of the enclosure. The bar passes directly in front of the baby's face, in position to intercept hazards before they contact the baby. Preferably, this rod would also be a polycarbonate or HDPE material but this can be altered to adjust the desired strength and stiffness. If desired, a rigid rod or vertical extension of the frame can also be used. The preferred method of joining rod, 344, to the head enclosure is to use T couplings, 348 and 350. Coupling 348 attaches the upper end of the rod to the existing rod, 320, which supports the head enclosure. The connection of this coupling to rod, 320, is sufficiently free to allow rod, 320, to pivot. This allows the enclosure to collapse for storage. Coupling, 350, joins the lower end of the rod to new rod, 346, which is sewn into the lower front edge. If desired, this connection can be fixed to prevent rotation of coupling, 350, about rod, 346. This may be done by fixing rod, 346, to the fabric; by bracing the vertical portion of coupling, 350, against the fabric; or by extending the rod down the front of the body of the cover and attaching it to, or bracing it against the inside of, the fabric. By preventing the rotation of the coupling, the rigidity of the bar is increased because it must then flex in order to move backward when impacted. Clearly, other known methods of connecting the rod to the enclosure can also be used. Alternatively, the lower rod, 346, could be left unattached to the enclosure. By positioning the lower rod within the body of the enclosure, any impact would push the lower end of the rod forward, into contact with the enclosure, or the carrier, which would then halt further movement.

Figure 8:
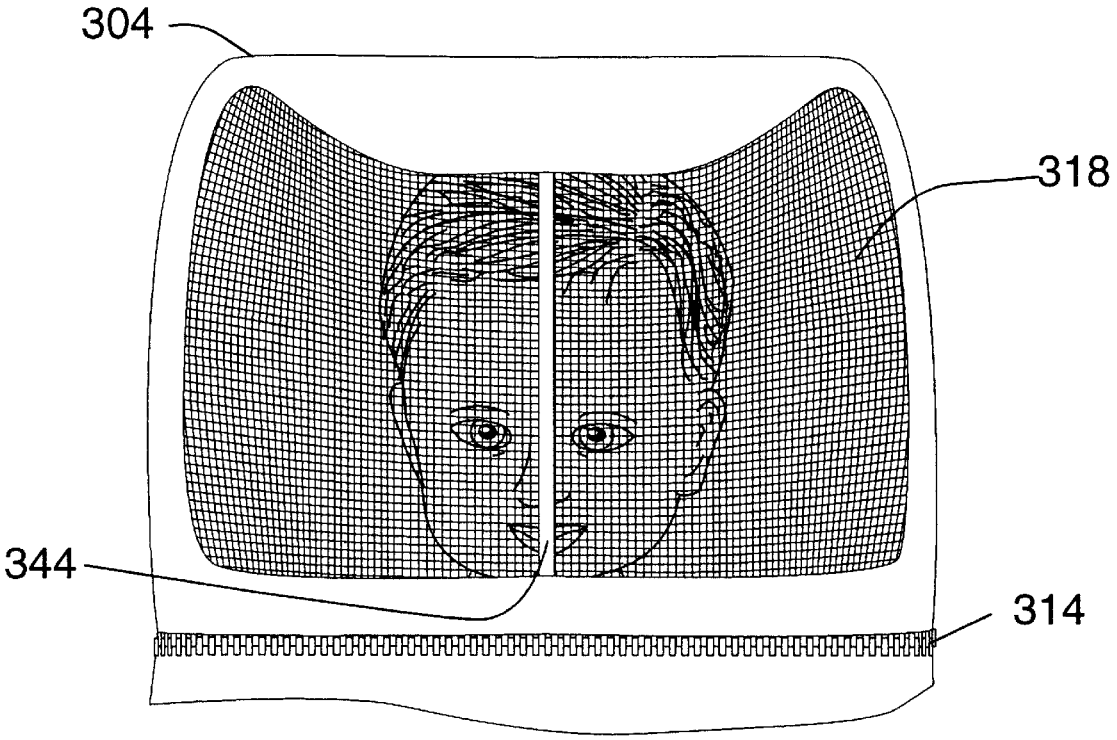
FIG. 8 provides a detailed view of an alternative embodiment of the head enclosure utilizing a support rod.
Figure 9:
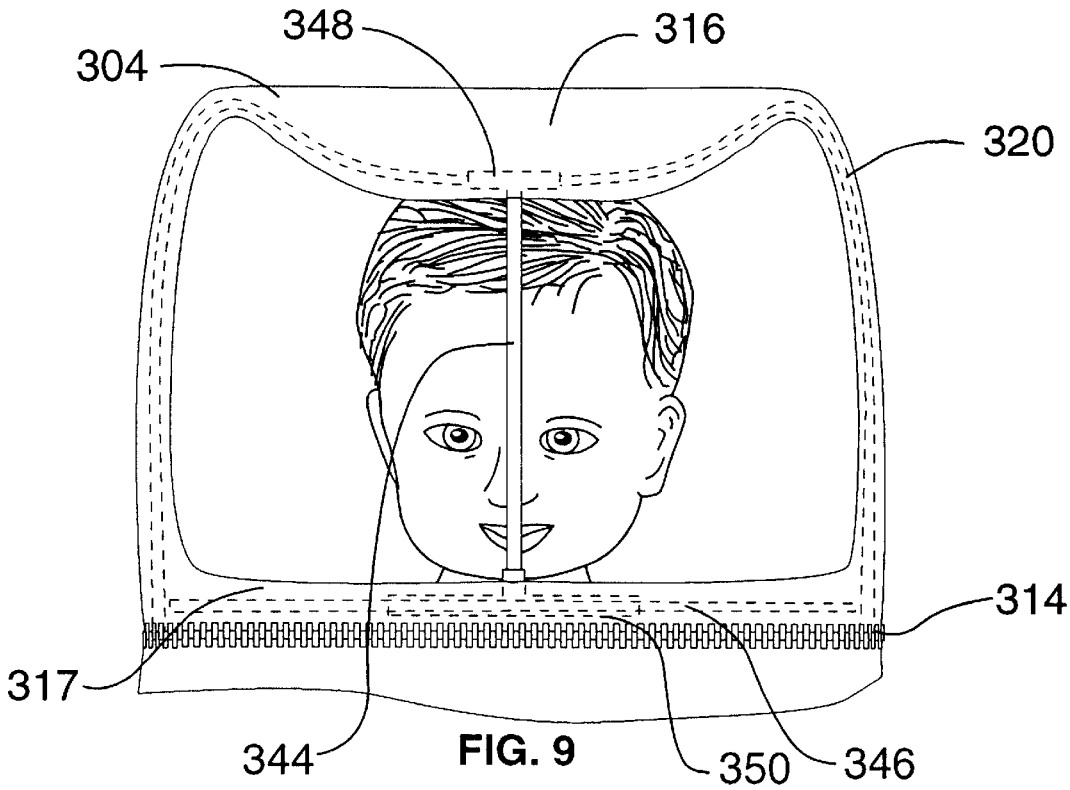
FIG. 9 provides a detailed front view of support rods used in the alternative embodiment for the head enclosure.
Figure 10:
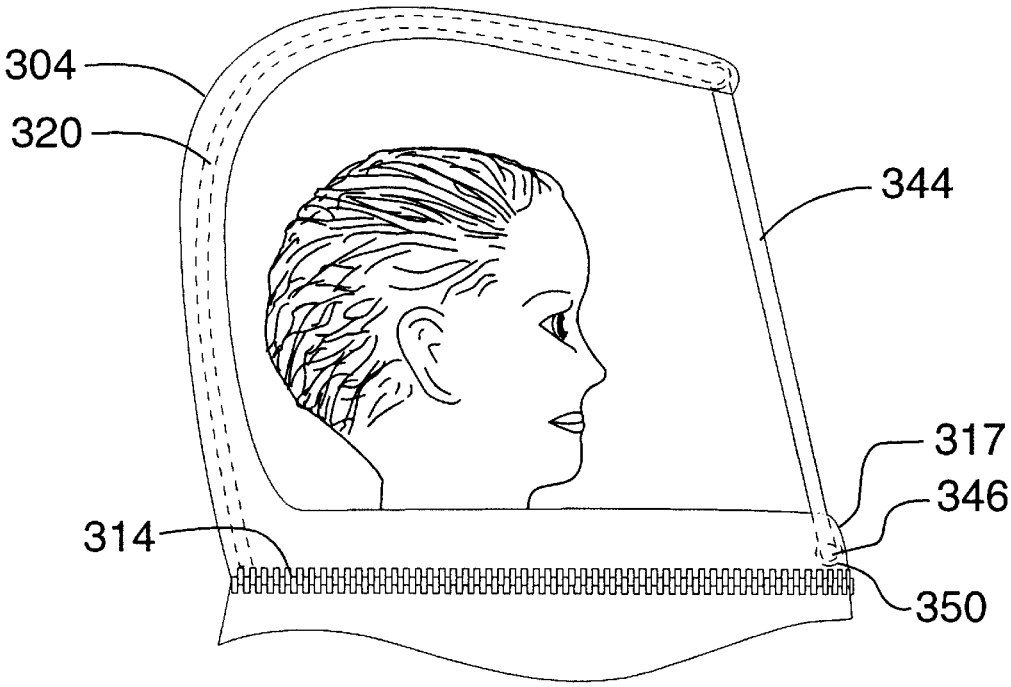
FIG. 10 provides a detailed side view of support rods used in the alternative embodiment for the head enclosure.
Figure 11:
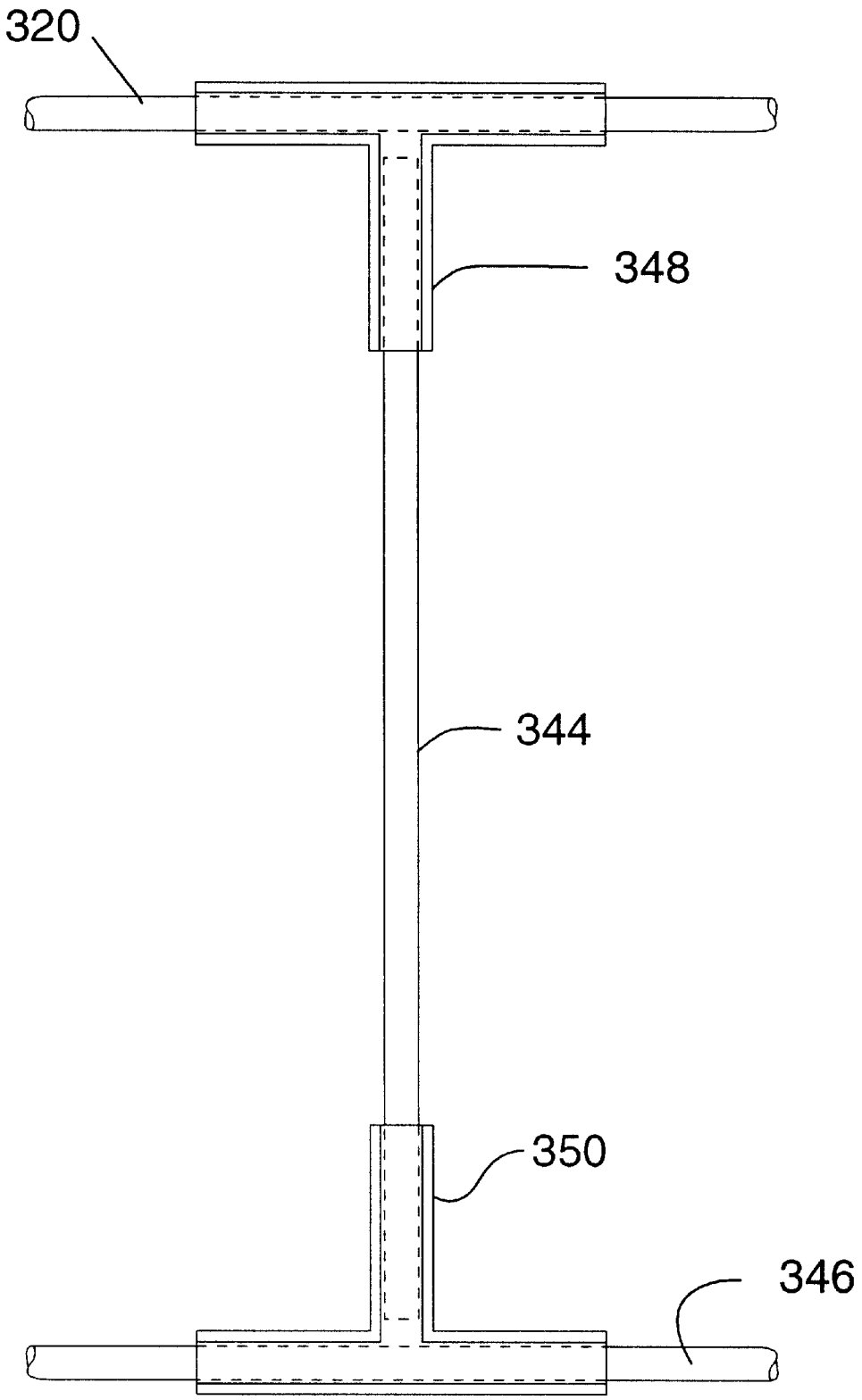
FIG. 11 provides a detailed view of the interconnection of the support rods in the alternative embodiment for the head enclosure.

As shown in FIG. 8, the additional bar, 344, may be used in combination with mesh panel 318. The bar may also be used without the mesh panel as shown in FIGS. 9 and 10. In this configuration, the bar assumes the role, usually served by the mesh panel, of supplying the downward force necessary to hold the rod, 320, and opaque panel, 316, in position. While not providing the insect protection of the normal configuration, this option does provide sun protection and impact protection against objects positioned laterally across the carrier.

Several alternatives exist for attaching the rod, 344, to the cover. It may be permanently or removably fixed to the lower front edge, 348, of the head enclosure, as illustrated. This arrangement is the simplest to use as the rod is attached and detached using the normal attachment mechanism for the head enclosure. However, if it is desired to use the head enclosure without the mesh panel, a separate mechanism must be supplied to detach the panel from the surrounding edges of the enclosure. Alternatively, the bar can be separately attached to the body of the cover. This allows the enclosure to be used without the mesh panel simply by releasing the zipper, 314, folding the panel under the top of the enclosure, behind the baby's head, and using the rod to hold the top panel, 316, of the enclosure in place. If desired a retaining mechanism, such as a strap, can be added to retain the mesh panel in position underneath the top panel. While requiring two steps to secure the head enclosure, the overall process may be easier. First, the top panel is pulled forward and down and secured in position by attaching the rod to the front of the cover. Second the zipper is closed, sealing off the mesh panel. This step may be easier as the panel will be under significantly reduced tension as a result of being held in place by the rod.

A second alternative embodiment is to provide an additional panel, or panels, which can be draped over the mesh panel, 318, of the head enclosure for increased sun, rain, and snow protection. The panel(s) may be permanently or removably fixed to the opaque panel, 316. When not needed, the panel will be folded back to lie along the top of the enclosure, or detached. When needed, it will be flipped down to cover all or a portion of the mesh panel. Optionally, a pocket attached to panel, 316, could be added to store the additional panel. Where removable fasteners are used, a panel which is smaller than the complete span of the mesh panel can be used. The position of the panel can then be adjusted as needed to block off only that portion of the mesh panel through which sun is entering. A similar approach can be applied to the panels in the body of the cover. If desired, multiple panels can be attached to increase the protected area or to shield more than one mesh panel. By providing the added panel with fasteners along the bottom, it can also serve as a wind barrier to protect the baby from wind. A further alternative would be to utilize mesh for all panels of the head enclosure, providing maximum ventilation. A supplemental opaque panel could then be attached via removable fasteners as, and where, needed for sun protection.

Another alternative embodiment is to add a baffle to the ends of the zipper, 314, which hold the head enclosure in place. With some zipper designs, when the zipper is closed a small gap may be left open at the end of the zipper through which small crawling insects may enter. An additional flap over the end of the zipper would block this gap. The flap would be secured by hook and loop fastener or other conventional fasteners.

A further alternative is to add a printed pattern to the mesh material. This allows the mesh to better contribute to the color scheme and appearance of the cover. While primarily for aesthetic purposes, the addition of the pattern to the mesh may also increase the amount of sun protection provided by the mesh as well as either increasing the amount of privacy provided or improving visibility into the cover. Certain pattern and color combinations make it very difficult to see through the mesh, offering increased privacy. Other pattern and color combinations actually make it easier to see through the mesh, making it easier to monitor the baby.

Another alternative embodiment is to impregnate the mesh panel with a non-toxic insect repellent. This treatment may be provided during the manufacture of the material or during the manufacture of the cover and could be supplemented by the end user of the cover. This treatment offers the advantage of repelling insects which land on, or crawl onto the cover. By repelling the insects, the amount of time they will have to locate any gaps or openings in the cover will be significantly reduced. Further, they will not remain on the surface of the mesh, possibly becoming an irritant to the baby. The opaque material may also be similarly treated if desired.

While the preferred form of the invention has been disclosed above, alternative methods of practicing the invention are readily apparent to the skilled practitioner. The above description of the preferred embodiment is intended to be illustrative only and not to limit the scope of the invention.

What is claimed is:

1. A fully enclosable backpack baby carrier adapted to support a baby comprising:

a) a structure adapted to support the baby;

b) plural carrying straps, adapted to support said structure;

c) a fabric enclosure for surrounding the baby, supported by said structure, comprising:

i) a body comprising at least a portion of insect resistant mesh, said body adapted to enclose at least a lower portion of the baby;

ii) a head enclosure comprising at least a portion of insect resistant mesh, adapted to cover the head of the baby; and iii) means for securing said head enclosure to said body.

2. The fully enclosable backpack baby carrier of claim 1 wherein said carrying straps are attached to said fabric enclosure.

3. The fully enclosable backpack baby carrier of claim 1 wherein said carrying straps are attached to said structure.

4. The fully enclosable backpack baby carrier of claim 1 wherein said body comprises an uninterrupted pocket enclosed by said structure.

5. The fully enclosable backpack baby carrier of claim 1 wherein said insect resistant mesh has a porosity of at least 1200 openings per square inch.

6. The fully enclosable backpack baby carrier of claim 1 wherein said insect resistant mesh comprises at least 40 pounds per square inch burst strength.

7. The fully enclosable backpack baby carrier of claim 1 wherein said mesh comprises a diffusing mesh to reduce the intensity of inclement weather within said protective enclosure.

8. The fully enclosable backpack baby carrier of claim 1 wherein said head enclosure has a top and a rear panel and at least one of said panels comprises material at least 95% opaque to ultraviolet rays.

9. The fully enclosable backpack baby carrier of claim 1 wherein said head enclosure further comprises means to support said head cover out of contact with the occupant's head.

10. The fully enclosable backpack baby carrier of claim 9 wherein said support means comprises a resilient rod.

11. The fully enclosable backpack baby carrier of claim 9 further comprising an impact guard attached to said support means.

12. The fully enclosable backpack baby carrier of claim 9 wherein said impact guard is pivotally attached to said support means.

13. The fully enclosable backpack baby carrier of claim 9 wherein said head enclosure has an upper panel and said support means comprises a single, arcuate resilient rod fixed at both ends to said enclosure and attached to the outer edges of said upper panel.

14. The fully enclosable backpack baby carrier of claim 1 wherein at least a portion of said mesh is imprinted with one or more colors, whereby visibility into said enclosure is altered.

15. The fully enclosable backpack baby carrier of claim 1 wherein at least a portion of said mesh is treated with an insect repellent.

16. The fully enclosable backpack baby carrier of claim 1 wherein said means for securing said head enclosure to said body comprises a seal which prevents the entry of small insects into said enclosure through said means for securing.

17. The protective enclosure of claim 1 wherein said fabric enclosure is removably attached to said structure.

18. The protective enclosure of claim 1 wherein said enclosure body comprises a lower panel which is impermeable to liquid water and permeable to water vapor.

19. The protective enclosure of claim 1 further comprising a storage compartment contained within said enclosure, accessible from the exterior of said carrier without creating an opening in said enclosure.

20. The protective enclosure of claim 19 wherein said compartment is positioned to be between the legs of the baby.

21. A fully enclosable backpack baby carrier adapted to support a baby comprising:

a) a structure adapted to support the baby, b) plural carrying straps, adapted to support said structure;

c) a fabric enclosure for surrounding the baby, supported by said structure, comprising:

i) a body adapted to enclose at least a lower portion of the baby and comprising an uninterrupted pocket enclosed by said structure;

ii) a head enclosure comprising at least a portion of insect resistant mesh, adapted to cover the head of the baby, and comprising support means to support said head cover out of contact with the occupant's head; and iii) means for securing said head enclosure to said body, comprising a seal which prevents the entry of small insects into said fabric enclosure.

22. The fully enclosable backpack baby carrier of claim 21 wherein said support means comprises a resilient rod.

* * * * *